US005683264A

United States Patent [19]

Hobgood et al.

[11] Patent Number: 5,683,264

[45] Date of Patent: Nov. 4, 1997

[54] PCMCI CABLE CONNECTOR WITH LATCHING INDICATOR

[75] Inventors: Leonard Douglas Hobgood, Durham; Harry Pasterchick, Jr., Raleigh, both of N.C.

[73] Assignee: International Business Machines Corporation, Armonk, N.Y.

[21] Appl. No.: 551,505

[22] Filed: Nov. 1, 1995

[51] Int. Cl.[6] ..... H01R 13/627

[52] U.S. Cl. ..... 439/352; 439/489

[58] Field of Search ..... 439/352, 488, 439/489, 953, 357, 372

[56] References Cited

U.S. PATENT DOCUMENTS 4,946,404 8/1990 Takenouchi et al. ..... 439/352
5,370,550 12/1994 Alwine et al. ..... 439/357
5,387,110 2/1995 Kantner et al. ..... 439/352

*Primary Examiner*—Khiem Nguyen
*Assistant Examiner*—Yong Ki Kim
*Attorney, Agent, or Firm*—Joscelyn G. Cockburn

[57] ABSTRACT

A latching connector assembly includes a mechanism which provides audible and tactile sensation indicating that the parts of the connector assembly are latched or unlatched (opened). The mechanism includes fixed obstructions or protrusions (molded-in detents) disposed on both sides of the latching shaft located in the fixed portion of the plug part of the connector assembly. Latching posts are provided on the movable portion (latch mechanism) of the plug part. The posts co-act with the protrusions, as the latching mechanism is moved forward or backward in the latch shaft, causing an audible sound and positive/tactile feel, when latching or unlatching the plug part to the receptacle part of the connector assembly.

19 Claims, 6 Drawing Sheets

PCMCI CABLE CONNECTOR WITH LATCHING INDICATOR

BACKGROUND OF THE INVENTION

1. Cross Reference to Related Patent Application

U.S. patent application entitled "Reversible Dual Media Adapter Cable", Ser. No. 08/332,681 filed Nov. 1, 1994 and assigned to IBM, assignee of the present invention, describes a reversible latching connector part and cable for coupling a PC to a wired LAN. The latching connector part has no mechanism to indicate if the part is latched or not latched with respect to a mating part.

2. Field of the Invention

The present invention relates to electrical connectors in general and, in particular, to connectors for interconnecting a personal computer (PC) to a wired Local Area Network (LAN).

3. Prior Art

The use of electrical connectors and cables for coupling electrical appliances to power systems, computers to wired LAN's or other communication network are well established in the prior art. The prior art electrical connectors consist of a plug part and a receptacle part which transmit electrical signals when coupled in mating relation. The cable connects either the plug part or the receptacle part to a wired system.

Broadly speaking, electrical connectors can be classified into two groups. One type of the two groups includes electrical connectors used to interconnect computers, telephones and similar devices. U.S. Pat. No. 5,387,110 is an example of prior art connectors for connecting computers to wired networks. The patent relates to the present patent application. The patent describes a reversible latching connector which connects a computer to different types of media.

The other type of electrical connectors passes electrical signals, not including voice and/or digital signals. Included in this group are connectors which pass power signals. Prior art examples of power transmitting connectors include the below listed US patents.

| U.S. Pat. No. | Inventor |
|---|---|
| 2,049,093 | Thorin |
| 3,394,337 | Miller |
| 3,431,537 | Klingenberg |
| 3,533,045 | Henschen |
| 4,083,619 | McCormick et al |
| 4,362,348 | Stephenson et al |
| 4,370,013 | Niitsu et al |
| 4,694,544 | Chapman |
| 4,810,206 | Rosenfeld et al |
| 5,192,226 | Wang |
| 5,387,110 | Kantner et al |

The present invention to be described hereinafter can be used with either type of prior art connectors. A latching mechanism is a desirable feature on both types of prior art connectors. The latching mechanism ensures that both parts of the connector are securely connected. U.S. Pat. Nos. 4,083,619 and 5,387,110 disclose latching mechanisms. In either patent, a user cannot determine when the latching mechanism is active (i.e., locked or is opened). Being able to determine when the latching mechanism is active would be a new and desirable feature for connectors. The present invention set forth below provides this new and desirable feature.

SUMMARY OF THE INVENTION

It is a main object of the present invention to provide an improved connector assembly that has not heretofore been possible.

It is another object to provide a device which indicates to a user if a latching connector is in a latched or unlatched state. The device includes fixed obstructions or protrusions (molded-in detents) disposed on both sides of the latching shaft located in the fixed portion of the plug part of the connector assembly. Latching posts are provided on the movable portion (latching mechanism) of the plug part. The latching posts co-act with the protrusions as the latching mechanism is moved forward or backward in the latching shaft, causing an audible and positive/tactile feel, when latching or unlatching the plug part to the receptacle part of the connector assembly.

DETAILED DESCRIPTION OF THE EMBODIMENT

The invention to be described hereinafter can be used with any of the above described types of connector assembly. The invention works well with PCMCIA I/O connectors and will be described in that environment. However, this should not be construed as a limitation upon the scope of the present invention since it is well within the skill of one skilled in the art to amend the invention to extend its usage with other types of connectors.

The above cross-referenced patent application and U.S. Pat. No. 5,387,110 are incorporated herein by reference and form part of the specification and disclosure of the present invention. To the extent sections of the incorporated documents are necessary to support the claims in the present invention, those sections will be described hereinafter. It being understood that details of the connector assembly can be obtained from the incorporated documents.

Figure 4:
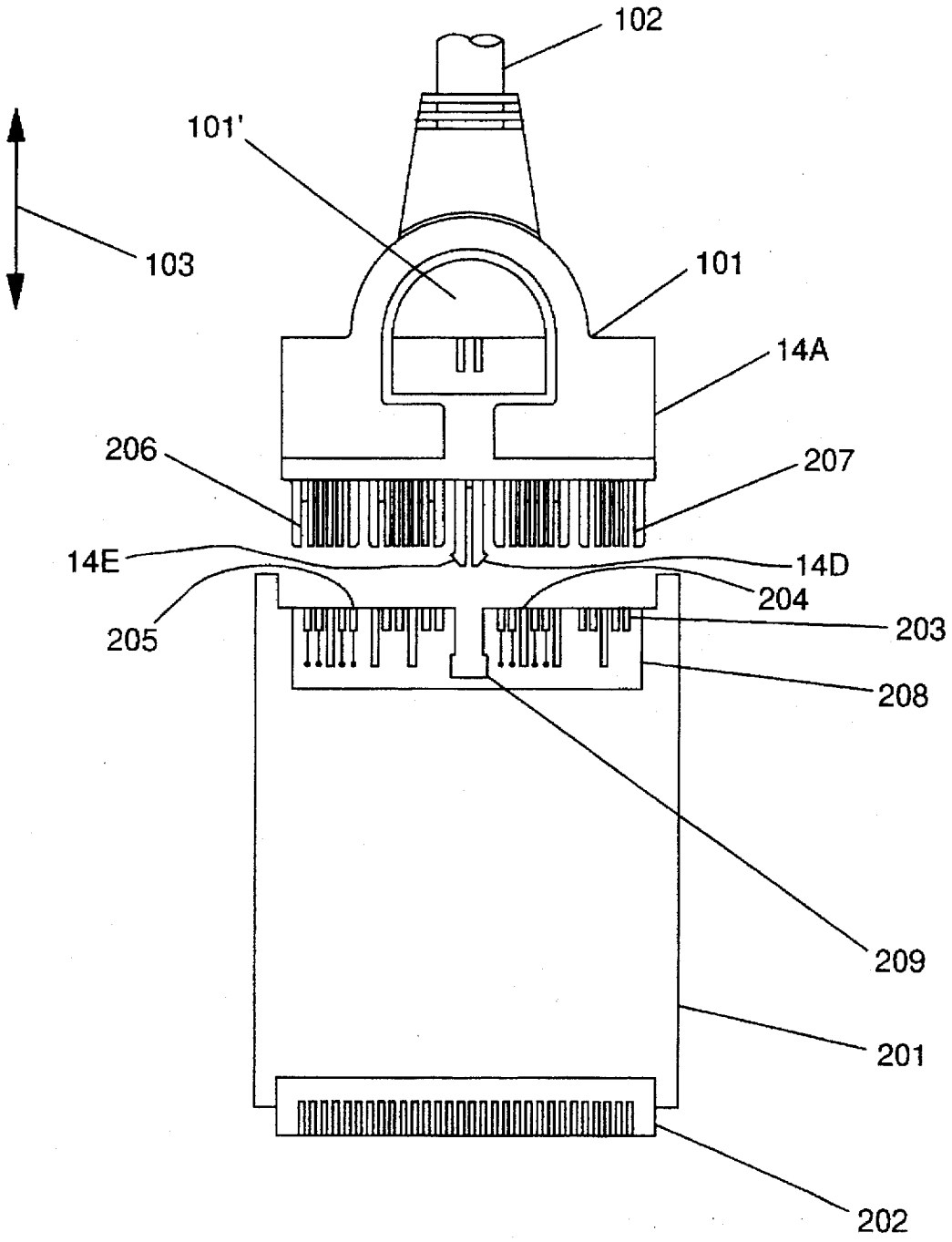
FIG. 4 shows a plug connector positioned to a mate with a receptacle connector on an adapter card. The plug connector and receptacle connector are shown with pin and socket connections exposed.
Figure 5:
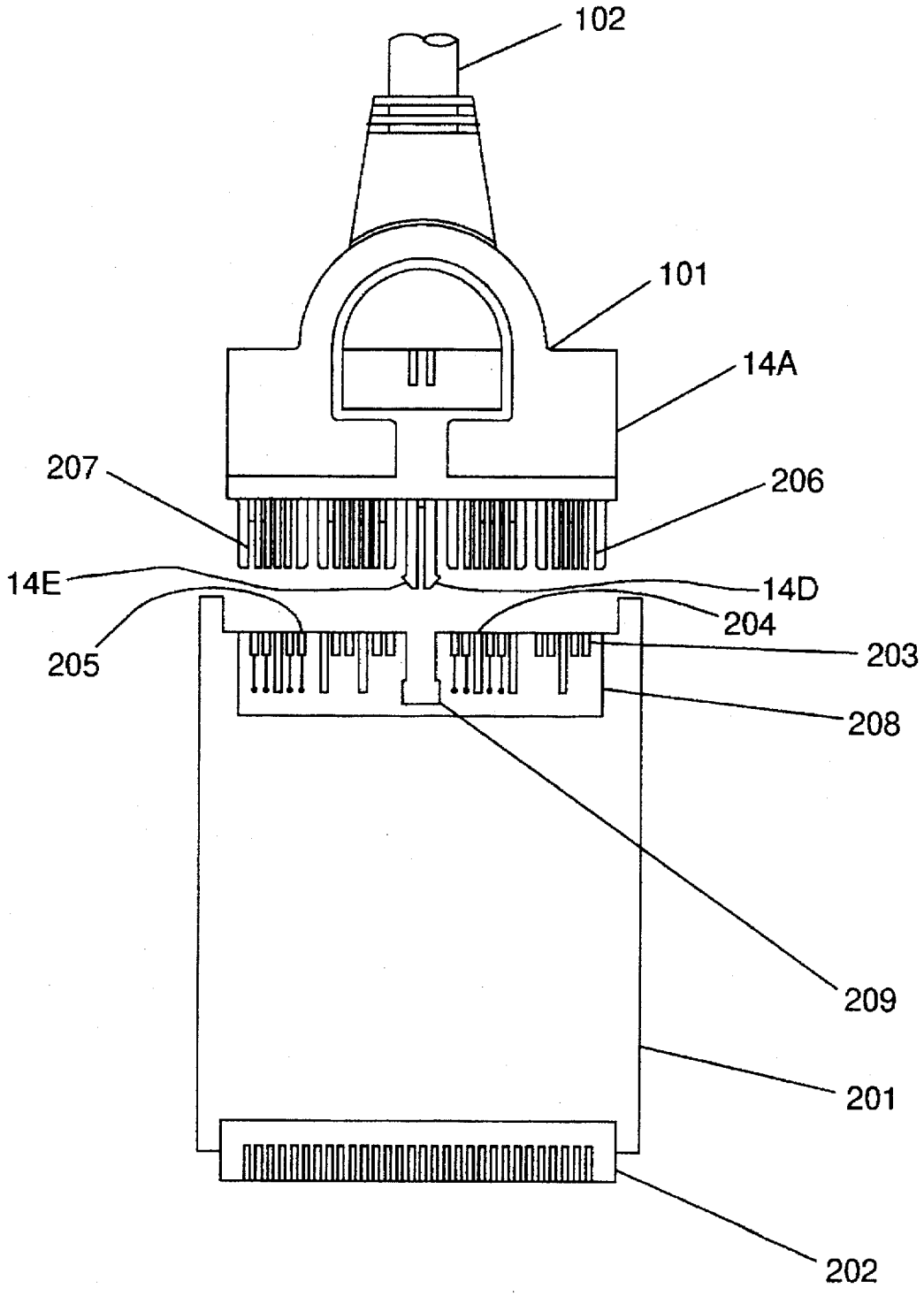
FIG. 5 shows the same plug connector and adapter card as FIG. 4, except that the plug connector is rotated 180° from its position in FIG. 4 to position a different set of contacts to co-act with a different set of contacts in the receptacle connector.

FIGS. 4 and 5 show plug connector 101 aligned to be mated with receptacle connector 208. The receptacle connector 208 is mounted on adapter card 201. The adapter card 201 is mounted in an expansion slot of a personal computer (PC), not shown, and couples the PC via bus connector 202 to the bus of the PC. The receptacle connector 208 includes a central opening (209) and a ledge as shown disposed in the circumferences of the opening. A plurality of conducting pins on plug connector 208 are connected to signal trace of the adapter card 201. For example, a pin connection for signal trace on the adapter card is shown at 205. A ground connections is shown at 204 and an unconnected pin trace is shown at 203.

Still referring to FIGS. 4 and 5, the plug connector 101 has a fixed section 14A to which a pair of deflecting arms 14D and 14E are attached. The conductive pins on the socket portion of plug connector 101 are connected to traces on a circuit board (not shown) and the traces are connected to conductors in the cable 102 which is attached to the plug connector. An example of a connection to a socket is shown on 206 with partial shading whereas an unconnected socket is shown with an opening depiction as at 207. When the plug section is fully mated with the receptacle connector, the deflection arms of the plug connector penetrate opening 209 and lodge against the ledge in the opening. The actuator button 101' is transported or moves in the direction shown by arrow 103 to cause a rod (not shown in FIGS. 4 and 5) to extended between the pair of deflecting arms and prevent them from collapsing, thus locking the arms against the ledge. To open the assembly, the button is moved in the opposite direction and the rod is withdrawn from the arm thus enabling them to collapse and the respective connectors are free to disengage.

Figure 6:
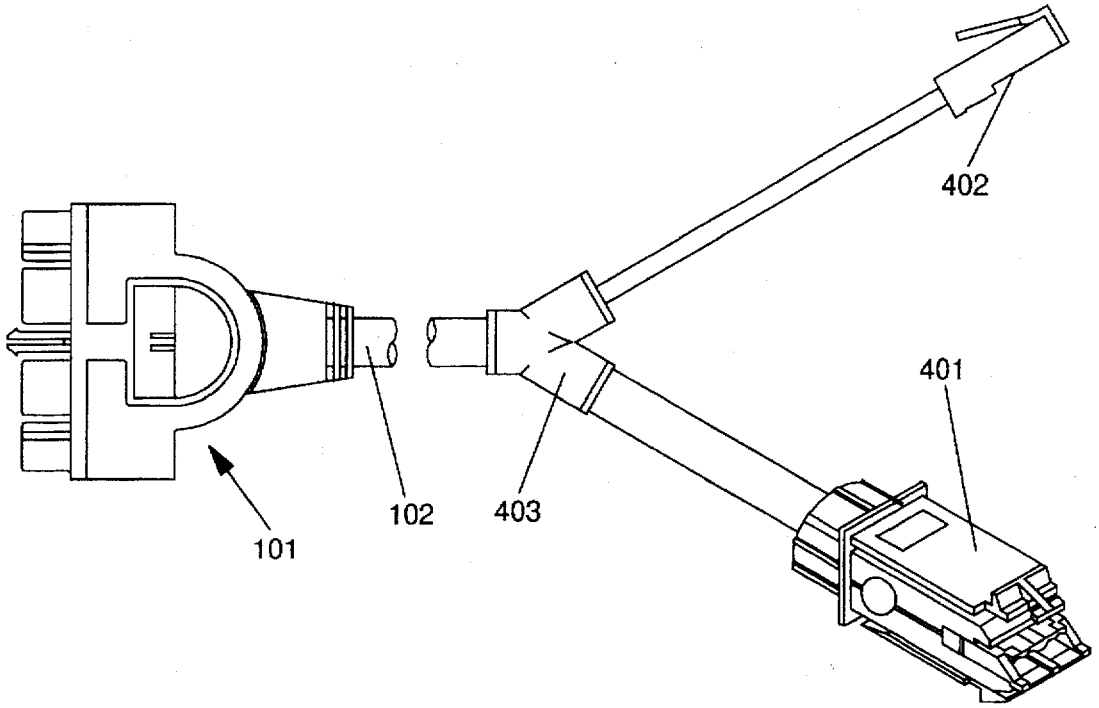
FIG. 6 shows an example of a complete overmolded adapter cable assembly.

FIG. 6 shows the complete adapter assembly with plug connector 101 connected by cable 102 and plastic boot 403 providing strain relief to couple the plug connector to connector 401 or connector 402. Each of the connectors 402 and 401 are adapted to attach to different wiring systems. The plug connector 101 can provide signals to either of these connectors by rotating 180°.

Figure 7:
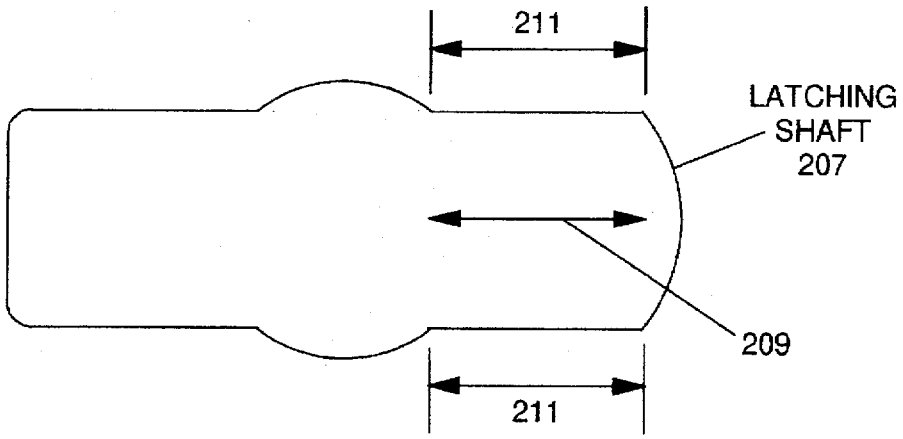
FIG. 7 (PRIOR ART)
FIG. 7 shows the prior art actuator ROD/Button shaft. The sketch is helpful in understanding the difference between the prior art structure and the present invention.

Turning to FIG. 7 for the moment, the latching shaft used in the incorporated patent and patent application is shown. The latching mechanism which moves the rod that prevents the arms from collapsing is moved along the direction shown by arrow 209. The internal walls of the latching shaft 207 which surrounds the opening in which the latching mechanism moves is substantially smooth and, consequently, presents no resistance to the latch mechanism as it moves bi-directionally to lock or unlock the plug connector to the receptacle connector. As a consequence, a user cannot tell when the connectors are locked or opened. It is this problem the present invention solves and the structure which solves this problem will now be described.

Figure 1:
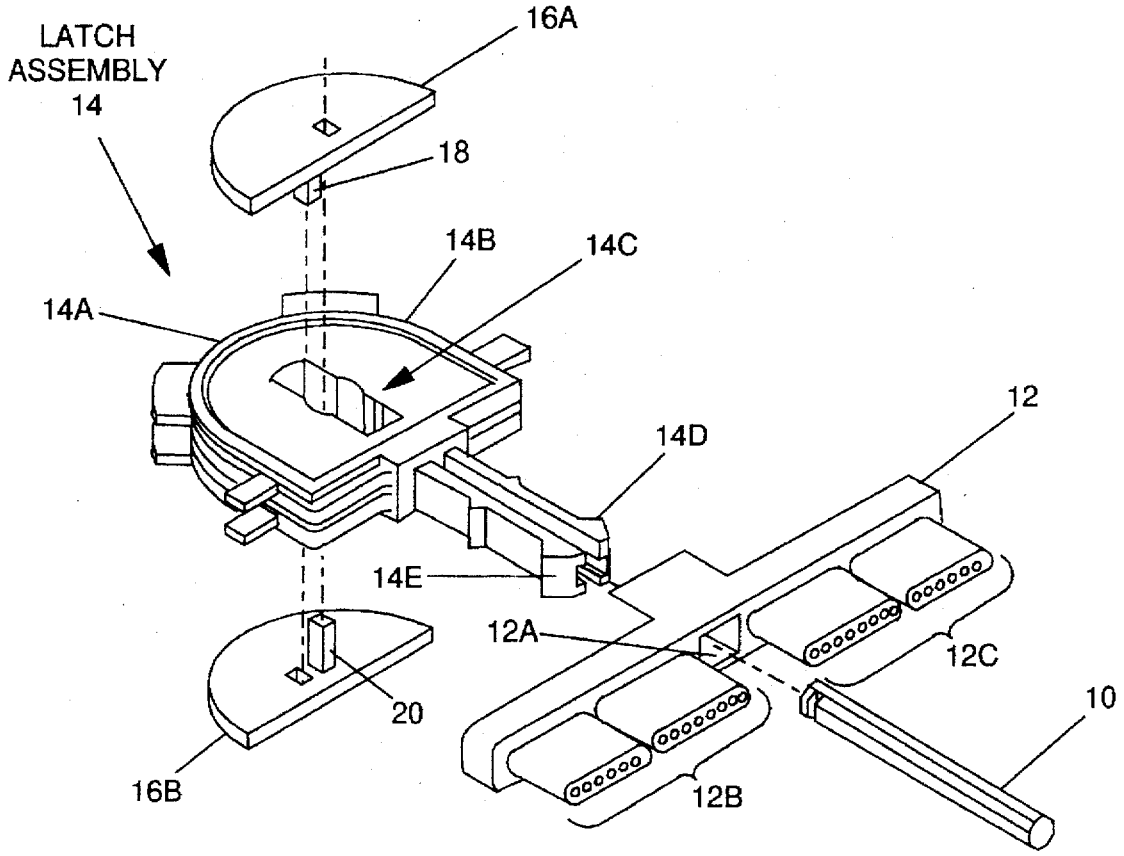
FIG. 1 shows the disassembled components of the plug part of the connector according to the teachings of the present invention.

FIG. 1 shows a disassembled plug connector according to the teachings of the present invention. The plug connector includes actuator rod 10, connector header 12 and latch assembly 14. The connector header 12 has a central opening 12A and supports the over molded sockets 12B and 12C which carries the conductive pins. The latch assembly 14 includes a fixed section 14A and a movable section comprising button halves 16A, 16B and the actuator rod 10 sandwiched between the two button halves. Each of the button halfs is fitted with latching post 18 and 20, respectively. Each of the latching posts are fixedly mounted to each of the button halfs and receptacle openings are provided in each half to receive the latching post from the opposite button half. The fixed section 14A of the latch assembly includes a "U" shaped section 14B in which a actuator rod/button shaft 14C is fabricated and deflecting arms 14D and 14E are attached. When the plug connector is assembled, the actuator rod 10 is trapped, between button halves 16A and 16B by latching posts 18 and 20, in the actuator rod/button shaft 14C and as the button halfs are moved in the shaft, the rod is extended between the deflecting arms 14D and 14E and prevents them from moving inwardly. The latching posts 18 and 20 co-act with the detents molded on inside surface of the actuator rod/button shaft to give the tactile feel and audible sound when the latching assembly is connected to or is released from the receptacle half of the connector.

Figure 2:
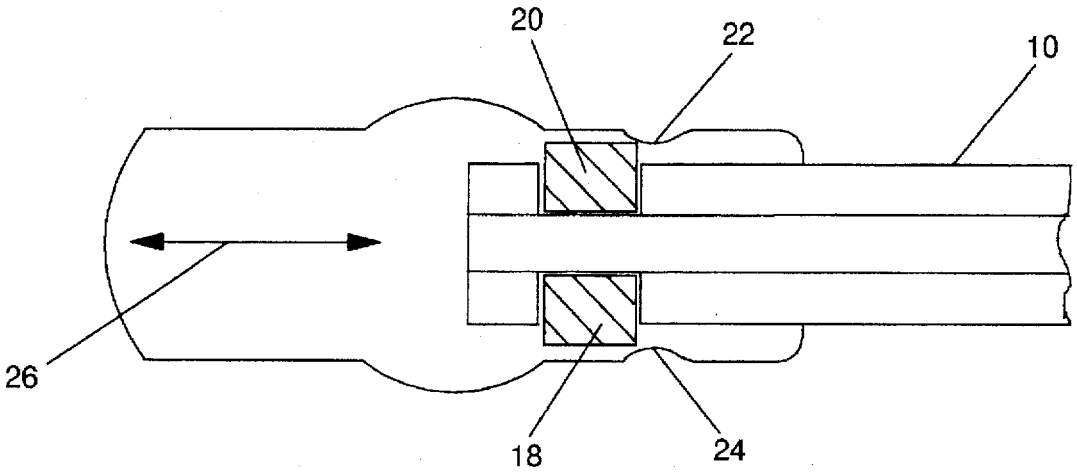
FIG. 2 shows the latch indicating device according to the teachings of the present invention (molded in detents).

FIG. 2 shows a cross section of the latching post, the actuator rod 10, and the actuator rod/button shaft. As opposed to the smooth prior art shaft in FIG. 7, protrusions or detents 22 and 24 are molded in the sidewalls of the shaft. As a consequence, as the actuator button formed by button half 16 A and 16B respectively (FIG. 1) are moved in the direction of arrow 26, the latching posts 18 and 20 co-act with the molded protrusion 22 and 24 to provide the tactile feel and snapping sound indicating that the mechanism is latched or unlatched. Stated another way, as the button latching posts 18 and 20 are moved forward along the latching shaft, they encounter the two molded in detents (one on each side) offering resistance and requiring a force of approximately 1.5 to 2.5 pounds to move the posts over the detents thus yielding an audible (positive/tactile) feel when latching or unlatching the cable connector to a card connector.

Figure 3A:
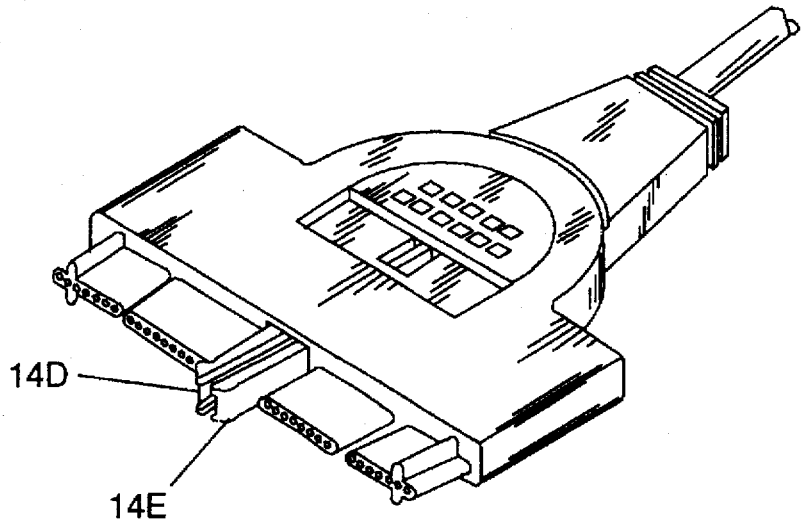
FIGS. 3A and 3B show top views of the plug part and cables according to the teachings of the present invention.
Figure 3B:
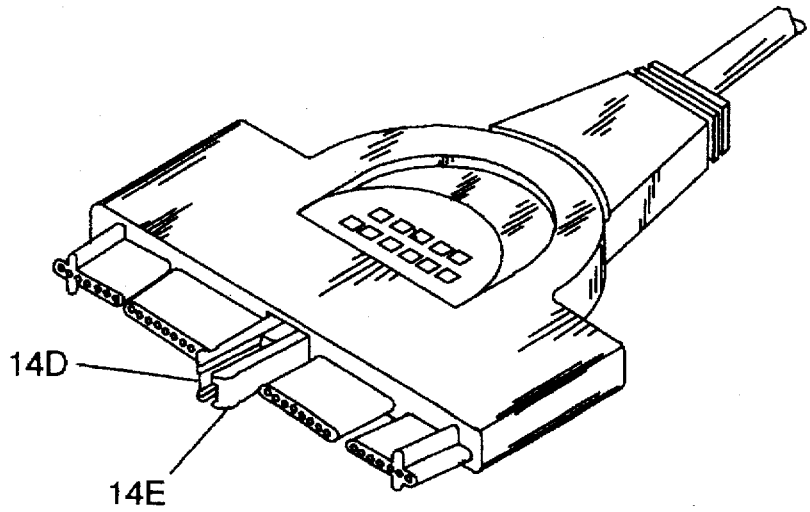

FIGS. 3A and 3B show molded over views with attached cable to the plug connector. In FIG. 3B, the actuator button 28 is in the locked position. This means the actuator rod 10 (FIG. 2) connected to the actuator button is extended between deflecting arms 14D and 14E. As discussed previously, the free ends of the deflecting arms mate with the ledges of the receptacle connector (FIGS. 4 and 5) when the connector halfs are in a latched state.

FIG. 3A shows the connector in the unlatched state. The actuator button is at the beginning of its travel path of the shaft and the rod is withdrawn from between the deflecting arms.

We claim:

1. In a connector assembly having a receptacle part, a plug part for mating with said receptacle part and a latching device which is transported along an opening fabricated in the plug part to lock the plug part and the receptacle part securely, an indicating device for indicating if the receptacle part and the plug part are locked or unlocked; said indicating device comprising:

at least a first member fabricated in the opening of said plug part, said at least first member projecting into the opening; and at least a second member mounted on the latching device; said at least second member being orientated so that as the latching device is transported along the opening the at least first member co-acts with the at least second member to offer resistance requiring additional force to move the latching device in a first direction into a locked state or in a second direction opposite to the first direction into an unlocked state wherein each of said at least first member and said at least second member is provided with a surface geometry which do not lock during co-action between said at least first member and said at least second member.

2. The indicating device of claim 1 wherein the at least first member includes detents molded onto the plug part said detents having curved surfaces thereon.

3. The indicating device of claim 1 or claim 2 wherein the at least second member includes posts.

4. An adapter cable assembly comprising:

a first connector having a housing in which a plurality of electrical contacts are arranged about a center point, the electrical contacts being operable for mating with a second connector in either a first position or a second position, with the first position and the second position being displaced 180 degrees relative to rotation about the center point;

at least one electrical cable connected to the housing, the electrical cable having at least a first group of signal conductors electrically connected to a first set of selected contacts of the plurality of contacts for transmitting electrical signals if the first connector is oriented in the first position, the electrical cable also having at least a second group of signal conductors electrically connected to a second set of selected contacts of the plurality of contacts for transmitting electrical signals if the first connector is oriented in the second position;

deflecting arms mounted on the first connector;

a central opening fabricated in said first connector;

a latching mechanism mounted into the opening and operable to be moved bi-directionally between the deflecting arms; and a device including a first structure mounted on the latching mechanism and a second structure mounted on a fixed section of the first connector wherein said first structure and second structure have surface profiles prohibiting locking when positioned in contact with each other to indicate if the plug connector is latched or unlatched.

5. The adapter cable assembly of claim 4 further comprising:

a first computer network connector fastened to the opposite end of the cable from the plug connector and electrically connected to the first group of signal conductors for coupling to a computer network.

6. The adapter cable assembly of claim 5 further comprising:

a second computer network connector fastened to the opposite end of the cable from the plug connector and electrically connected to the second group of signal conductors for coupling to a computer network.

7. The adapter cable of claim 4 wherein the first structure includes a detent molded on opposite sides of the opening; and the second structure includes a pair of elongated members mounted on the latching mechanism with each one of said pair of elongated members co-acting with a paired detent to provide audible indication and tactile feel as the elongated members are forced bi-directionally over center of the detents indicating latched or unlatched status.

8. An apparatus for interfacing a computer to a computer network comprising:

an adapter card;

a bus connector for interfacing the adapter card to the computer;

a receptacle connector operatively coupled to the adapter card; said receptacle connector having a plurality of matable electrically conductive contacts positioned relative to an opening with ledges thereon;

a plug connector having a plurality of matable electrically conductive contacts which co-act with the matable electrically conductive contacts on the receptacle connector when said plug connector is brought into mating relation with said receptacle connector; said plug connector further including deflecting arms fixedly mounted on the plug connector and said arms having enlarged sections at its free ends for contacting the ledges;

a movable latching mechanism disposed between the deflecting arms and operable to be moved to a first position whereat the deflection arms are held firmly against the ledges thus locking the receptacle connector and the plug connector together or operable to be moved to a second position whereat the deflecting arms are free to deflect from the ledges to place the receptacle connector and the plug connector in an unlocked state; and a device including a first detent with a curved surface thereon mounted on the plug connector and a first member for co-acting with the curved surface mounted on the movable latching mechanism, wherein equal force is being required to move the second member bi-directionally relative to the first detent and to indicate if the plug connector and receptacle connector are latched or unlatched.

9. The apparatus of claim 8 further including a second detent with a curved surface thereon mounted in spaced relationship to the first detent and a second member mounted in spaced relationship to the first member with said second member co-acting with the curved surface on the second detent.

10. The apparatus of claim 8 or 9 wherein the movable latching mechanism includes a rod; a thumb actuator and mechanism connecting the thumb actuator to the rod.

11. The device of claim 10 wherein the mechanism connecting the thumb actuator to the rod includes the first member and the second member.

12. In an electrical connector having a first connector section for mating with a second connector section, said first connector section comprising:

a housing having a plurality of electrically conductive contacts therein for mating with electrically conductive contacts in the second connector section if said first connector is brought into mating relation with said second connector section;

a pair of spaced deflecting arms mounted on the housing, with each one of the pair of spaced deflecting arms having an enlarged section at its free end for contacting a groove positioned within the second connector section;

a movable means disposed between the deflecting arms, said movable means operable to be moved to a first position whereat the deflecting arms are held firmly by said movable means against the groove to lock the first connector section and the second connector section together and operable to be moved to a second position whereat the deflecting arms are free to deflect from the groove to place the first connector section and the second connector section in an unlock state; and an indicating device including co-acting members with each one having non-lockable surface profile thereon, coupled to the housing and the movable means, for providing audible sensation and positive tactile feel as the first connector section and second connector section are transported bi-laterally to lock and unlock.

13. The electrical connector of claim 12 wherein the first connector section includes a plug connector.

14. The electrical connector of claim 12 wherein the first connector includes a receptacle connector.

15. The electrical connector of claims 12, 13, or 14 wherein the movable means includes a rod; and a thumb actuator connected to the rod.

16. The electrical connector of claim 12 further including a cable with a plurality of conductive wires operatively connected at one end to the plurality of conductive contacts in said housing; and at least another connector connected to another end of said plurality of conductive wires.

17. A connector assembly comprising:

a receptacle connector having a first set of electrically conductive contacts positioned relative to an opening with ledges thereon;

a plug connector having a plurality of matable electrically conductive contacts which co-act with the matable electrically conductive contacts on the receptacle connector when said plug connector is brought into mating relation with said receptacle connector; said plug connector further including deflecting arms fixedly mounted on the plug connector and said arms having enlarged sections at its free ends for contacting with the ledges;

a movable means disposed between the deflecting arms and operable to be moved to a first position whereat the deflection arms are held firmly against the ledges thus locking the receptacle connector and the plug connector together or operable to be moved to a second position whereat the deflecting arms are free to deflect from the ledges to place the receptacle connector and the plug connector in an unlocked state; and a device including spaced detents with curved surfaces thereon mounted on the plug connector and a pair of posts mounted in spaced relation on the movable latching mechanism, with each post co-acting with a spaced detent wherein bi-directional relative motion between a post and a detent indicates if the plug connector and receptacle connector are latched or unlatched.

18. An electrical connector section comprising:

a housing having a plurality of electrically conductive contacts therein;

a pair of spaced deflecting arms mounted on the housing, with each one of the pair of spaced deflecting arms having an enlarged section at its free end;

a movable means including a rod with a free end disposed between the deflecting arms and an actuator section connected by posts to another end of the rod, said movable means operable to be moved to a first position whereat the deflecting arms are held firmly by the rod inhibiting relative radial movement by said deflecting arms and operable to be moved to a second position whereat the deflecting arms are free to deflect radially; and an indicting device including the posts and curved surface detents, coupled to the housing and the movable means for providing audible sensation and positive tactile feel as the movable means is positioned between the deflecting arms and is retracted from between the deflecting arms.

19. The electrical connector of claim 18 wherein the first connector section includes a plug connector.

* * * * *